US006105334A

United States Patent [19]

Monson et al.

[11] Patent Number: 6,105,334

[45] **Date of Patent: *Aug. 22, 2000**

[54] FIRE RESISTANT LIGHTING ENCLOSURE

[75] Inventors: Kevin J. Monson; Christopher D. Jensen, both of Salt Lake City; Edward V. Calo, Park City, all of Utah

[73] Assignee: Logic Construction Systems, L.L.C., Park City, Utah

[ * ] Notice: This patent issued on a continued prosecution application filed under 37 CFR 1.53(d), and is subject to the twenty year patent term provisions of 35 U.S.C. 154(a)(2).

[21] Appl. No.: 08/932,187

[22] Filed: Sep. 16, 1997

[51] Int. Cl.[7] ..... E04F 19/00; E04B 101/00

[52] U.S. Cl. ..... 52/741.3; 52/28; 52/232; 52/742.1

[58] Field of Search ..... 52/28, 741.3, 742.1, 52/745.15, 745.16, 232; 362/145, 147, 148, 150

[56] References Cited

U.S. PATENT DOCUMENTS

| | | | |
|---|---|---|---|
| 2,717,955 | 9/1955 | Schwemmer et al. | 362/148 X |
| 3,915,777 | 10/1975 | Kaplan | 52/232 X |
| 4,069,075 | 1/1978 | Billing et al. | 52/232 X |
| 4,093,818 | 6/1978 | Thwaites et al. | 52/232 X |
| 4,210,070 | 7/1980 | Tatum et al. . | |
| 4,237,671 | 12/1980 | Munson . | |
| 4,276,332 | 6/1981 | Castle | 52/232 X |
| 4,375,142 | 3/1983 | McDonald . | |
| 4,400,673 | 8/1983 | Gilman . | |
| 4,400,766 | 8/1983 | Munson . | |
| 4,574,454 | 3/1986 | Dyson | 52/232 X |
| 4,751,624 | 6/1988 | Russo et al. . | |
| 4,930,054 | 5/1990 | Krebs . | |
| 5,103,609 | 4/1992 | Thoreson et al. | 52/232 |
| 5,222,800 | 6/1993 | Chan et al. . | |
| 5,351,448 | 10/1994 | Gohlke et al. | 52/232 X |
| 5,404,687 | 4/1995 | Blake et al. | 52/232 X |
| 5,546,711 | 8/1996 | Heller | 52/232 X |
| 5,823,664 | 10/1998 | Demshki, Jr. et al. | 362/366 |

FOREIGN PATENT DOCUMENTS

| | | |
|---|---|---|
| 2235710 | 3/1994 | United Kingdom . |
| 2270936 | 3/1994 | United Kingdom . |

OTHER PUBLICATIONS

Uniform Building Code Standard 7–1 Fire Tests of Building Construction and Materials.

*Primary Examiner*—Carl D. Friedman
*Assistant Examiner*—Timothy B. Kong
*Attorney, Agent, or Firm*—Cummings & Lockwood

[57] ABSTRACT

A structure for use in conjunction with a recessed fixture is provided which includes a substantially rectangular housing defining a top wall and side walls. Each of the walls has exterior and interior wall surfaces, and at least the interior wall surfaces of the housing are coated with a fire resistant material. Flanges depend outwardly from bottom edges of side walls of the housing to facilitate mounting of the housing between spaced apart building joists. The housing is coated with the fire resistant material prior to installation.

8 Claims, 4 Drawing Sheets

FIRE RESISTANT LIGHTING ENCLOSURE

BACKGROUND OF THE INVENTION

1. Field of the Invention

The subject invention relates to an apparatus for preventing the spread of fires in buildings, and more particularly, to fire resistant enclosures for recessed fixtures, such as, for example, lighting fixtures, as well as methods of fabricating and installing the same.

2. Background of the Related Art

In residential and commercial buildings it is commonplace to provide insulation materials between ceiling joists to reduce heat loss from the living spaces. It is also commonplace to install recessed fixtures, such as, for example, lighting fixtures and loudspeaker units, in the living spaces which include portions that extend through the ceiling between the ceiling joists. A typical twenty unit condominium building can have hundreds of recessed lighting fixtures.

It is well known that during use, recessed fixtures, and in particular recessed lighting fixtures tend to generate a significant amount of heat, and because some insulating materials unitized in residential buildings are combustible, a fire hazard generally exists. The Uniform Building Code (U.B.C.) requires that openings or penetrations for recessed lighting fixtures in all wood framed ceiling assemblies must be protected by a penetration firestop system. Such a system must limit the spread of fire, flame or hot gases through the firestop assembly for an acceptable period of time, when tested in accordance with the time-temperature curve provided in U.B.C. Standard 7-1, which is herein incorporated by reference.

There have been attempts in the prior art to provide fire rated enclosures which isolate recessed fixtures, such as lighting and speaker units, from combustible insulation materials so as to reduce the risk of fire, and which conform with applicable building codes to prevent the spread of fire. For example, it is known in the construction industry to build a sheet rock enclosure around a recessed lighting fixture to isolate the fixture from insulation materials, and to provide a suitable firestop system for the ceiling penetration. To accomplish this, the joist space in which the lighting fixture is to be installed must first be blocked by a carpenter so that the joists can carry the sheet rock enclosure. The sheet rock is then attached to the joists and sealed. This prior art method is extremely labor intensive and very costly.

An example of an insulation barrier constructed from a plurality of panels fabricated from a fire-proof material such as Portland cement reinforced with asbestos fibers, and joined together by clips is disclosed in U.S. Pat. No. 4,237,671 to Munson. The prefabricated panels are dimensioned to accomodate different joist spacings, but they must be constructed at the building site for utilization. Examples of preformed insulation barriers constructed from aluminum sheet metal are disclosed in U.S. Pat. No. 4,375,142 to McDonald and U.S. Pat. No. 4,400,766 to Munson. Both of these devices include perforations to facilitate construction, and therefore they do not provide a firestop system which conforms with applicable building codes. Furthermore, aluminum sheet metal is a relatively expensive material, and its usage adds significantly to the cost of construction. Clearly, there is a need in the art for an inexpensive preformed insulation barrier which conforms with the firestop requirements of applicable building codes.

SUMMARY OF THE INVENTION

The subject invention is directed to a preformed fire resistant enclosure for recessed fixtures employed in residential and commercial buildings which conforms with applicable building codes relating to firestop systems for ceiling/floor penetrations. In the specification which follows, the fire resistant enclosure of the subject invention is described and illustrated in conjunction with a recessed lighting fixture. However, those skilled in the art will readily appreciate that the fire resistant enclosure of the subject invention is suitable for use in conjunction with other recessed fixtures, such as, for example, loudspeaker units.

The enclosure includes a housing formed from common sheet metal, such as, for example, 26 gauge sheet metal, or a similar inexpensive readily available material. The housing is defined by a top wall and first through fourth side walls. The top wall and side walls have exterior and interior wall surfaces, and at least the interior wall surfaces of the enclosure have a fire resistant material provided thereon. It is envisioned that the fire resistant material may also be provided on the exterior surfaces of the enclosure to further enhance the fire suppression characteristics of the enclosure.

Generally planar flanges depend outwardly from bottom edges of the side walls of the housing for facilitating mounting of the housing between spaced apart building joists. Preferably, the first and third side walls of said housing are opposite one another and are dimensioned to facilitate mounting of the housing between joists spaced at 12.0 inch centers, and the second and fourth walls of the housing are opposite one another and are dimensioned to facilitate mounting of the housing between joists spaced at 16.0 inch centers. Thus, the fire resistant enclosure of the subject invention is readily adaptable to different joist spacing. Those skilled in the art will readily appreciate that the dimensions of the housing can be modified to accomodate other joist spacings.

Each of the side walls of the enclosure are preferably provided with an aperture to accomodate the passage of electrical wires associated with a lighting fixture. The apertures may be defined by perforated knock-outs which can be selectively opened to accomodate wiring. Preferably, the fire resistant material associated with the interior surfaces of the lighting enclosure is selected from a group of fire resistant materials consisting of cementitious and intumescent materials. Such materials are commercially available in a wide variety of forms including coatings, films or sheetings, and can be applied by spraying, rolling, brushing or other similar methods known in the art.

The subject invention is also directed to a method of installing recessed fixtures. This method includes the steps of providing a housing configured to enclose a recessed fixture, providing at least interior surfaces of the housing with a fire resistant material, and mounting the housing between spaced apart building joists. Preferably, the step of providing surfaces of the housing with a resistant enclosure precedes the step of mounting the housing between spaced apart building joists. Although, it is envisioned that at least interior surfaces of the enclosure may be provided with the fire resistant material after the enclosure has been mounted between spaced apart joists.

The method further includes the steps of emplacing a fixture within the housing, passing electrical wires through an aperture formed in at least one side wall of the housing, and sealing the aperture after passing the electrical wires therethrough. The method also includes the step of positioning the enclosure in a first orientation for mounting between building joists spaced at 12.0 inch centers, or positioning the enclosure in a second orientation for mounting between building joists spaced at 12.0 inch centers.

These and other features of the subject invention will become more readily apparent to those having ordinary skill in the art from the following detailed description of the invention taken in conjunction with the drawings.

BRIEF DESCRIPTION OF THE DRAWINGS

So that those having ordinary skill in the art to which the subject invention appertains will more readily understand how to make and use the fire rated recessed lighting enclosure of the subject invention, preferred embodiments thereof will be described in detail hereinbelow with reference to the drawings wherein.

DETAILED DESCRIPTION OF THE PREFERRED EMBODIMENTS

Figure 1:
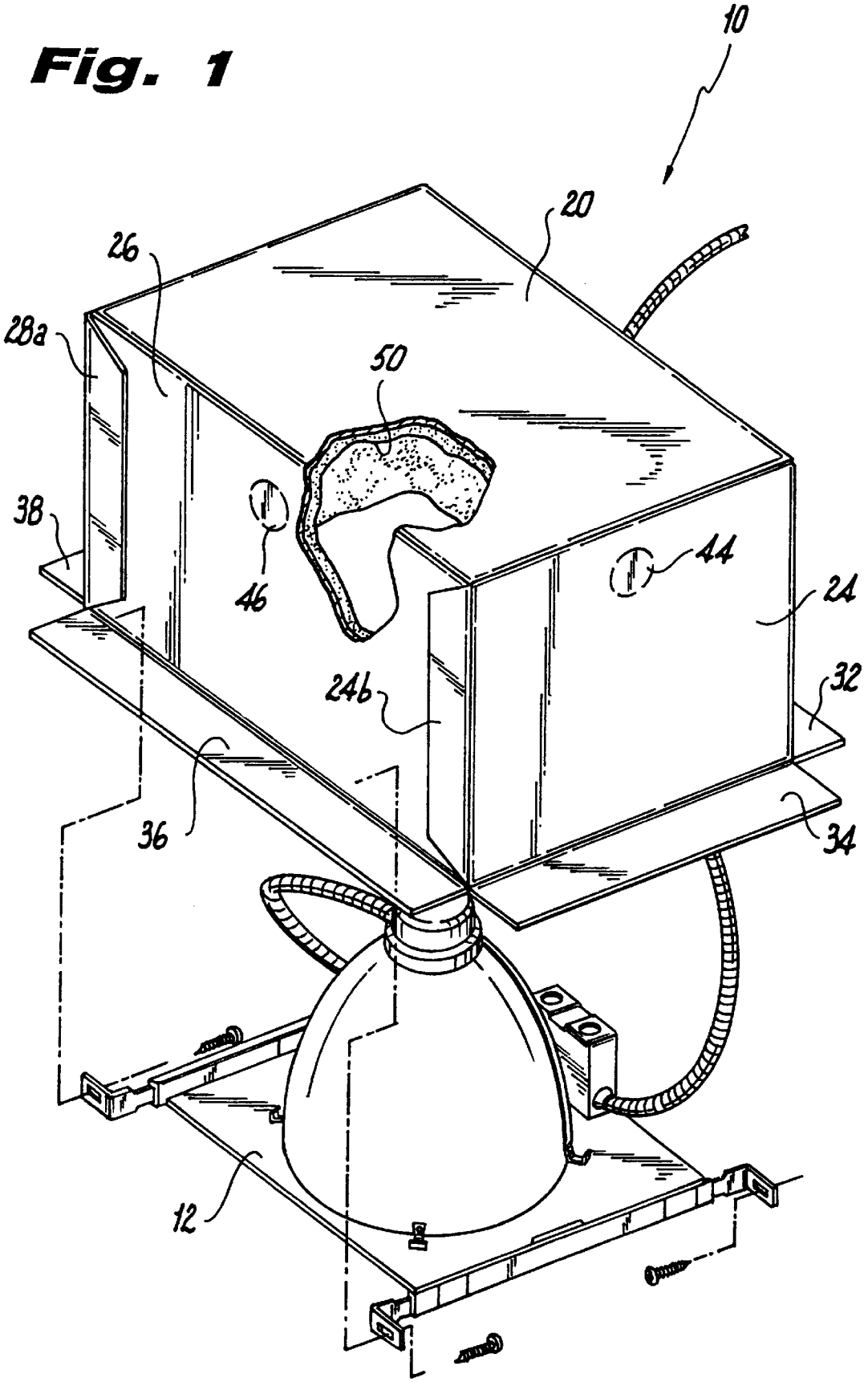
FIG. 1 is a perspective view of a lighting enclosure constructed in accordance with a preferred embodiment of the subject invention, sectioned to illustrate the fire resistant material provided on the interior surfaces thereof, and further illustrating the recessed lighting fixture which the enclosure is configured to house.

Referring now in detail to the drawings wherein like reference numerals identify similar structural elements of the subject invention, there is illustrated in FIG. 1 a fire rated lighting enclosure constructed in accordance with a preferred embodiment of the subject invention and designated generally by reference numeral 10. Lighting enclosure 10 has a generally rectangular box-like configuration and is configured to enclose a conventional recessed lighting fixture 12 when installed between adjacent ceiling joists, as shown for example in FIGS. 5 and 6. Once installed, the fire rated lighting enclosure 10 of the subject invention provides a lightweight, durable, readily adaptable structure which advantageously isolates a heat generating recessed lighting fixture 12 from combustible insulation material adjacent thereto, and prohibits the propagation of fire through the ceiling penetration associated with the lighting fixture in conformance with applicable building codes.

Figure 2:
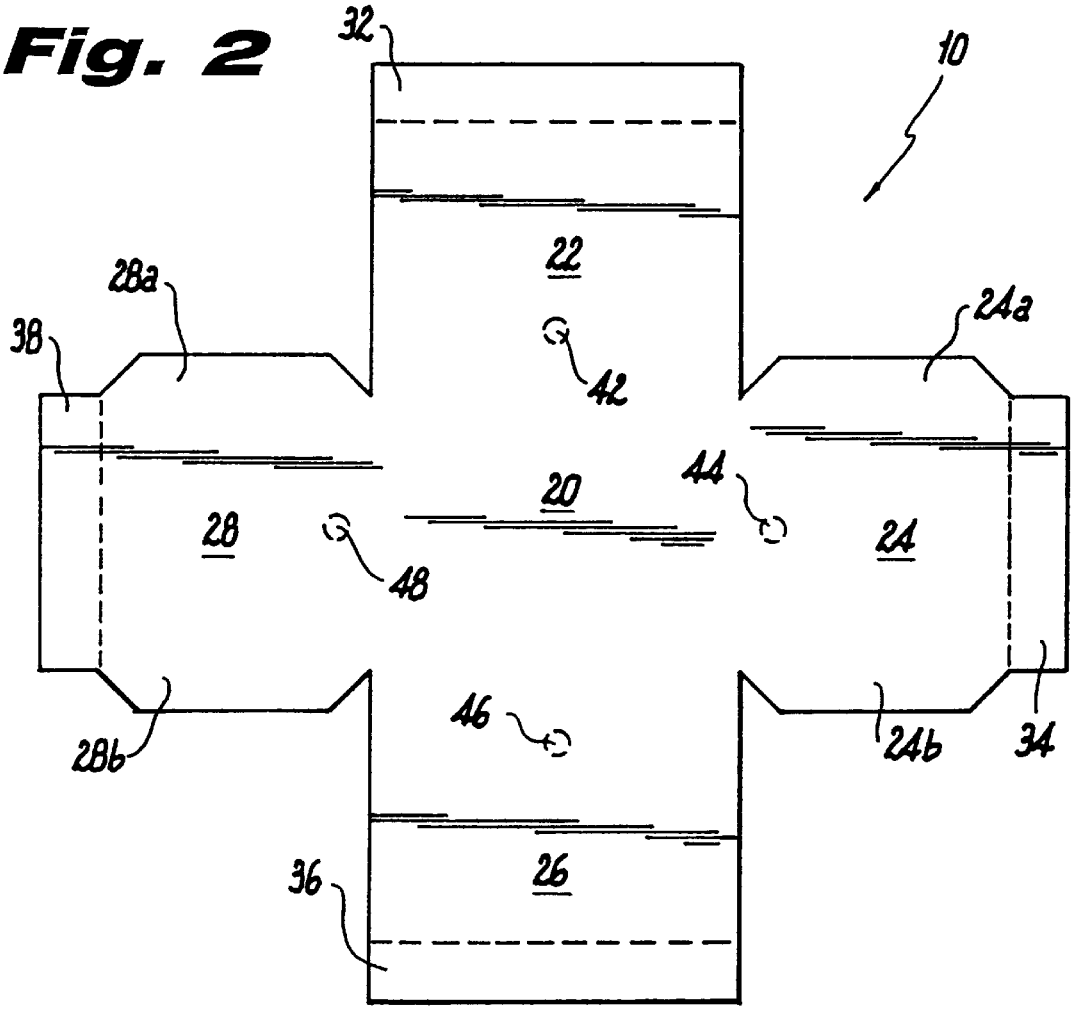
FIG. 2 is a top plan view of the stamped sheet metal blank from which the lighting enclosure illustrated in FIG. 1 is constructed.
Figure 5:
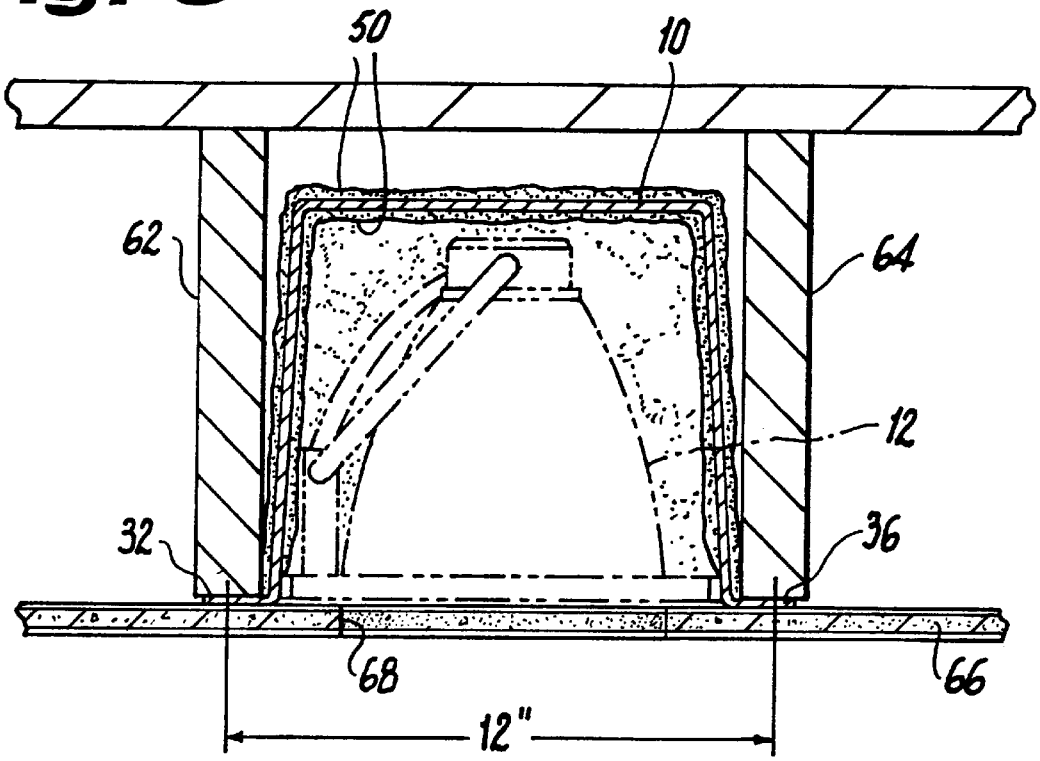
FIG. 5 is a side elevational view in cross-section of the lighting enclosure of the subject invention mounted in a first orientation between ceiling joists spaced at 12.0 inch centers.
Figure 6:
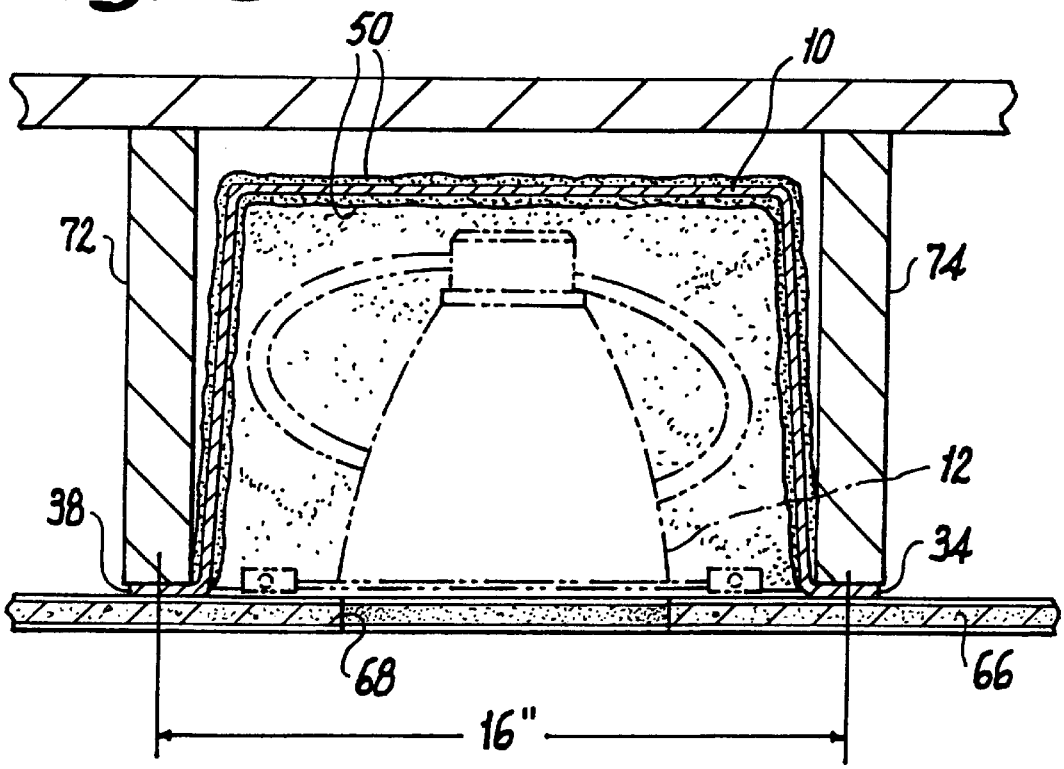
FIG. 6 is a side elevational view in cross-section of the lighting enclosure of the subject invention mounted in a second orientation between ceiling joists spaced at 16.0 inch centers.

Referring to FIG. 1 in conjunction with FIG. 2, lighting enclosure 10 is constructed from a blank which is stamped formed from conventional 26 gauge sheet metal, expanded metal, metal mesh, or a similar inexpensive material. Enclosure 10 includes a top wall 20 and first through fourth side walls 22, 24, 26 and 28. The first and third side walls 22 and 26 are opposite one another and have a greater lengthwise dimension than the opposed second and third side walls 24 and 28. More particularly, the lengthwise dimension of the first and third side walls 22 and 26 is selected to facilitate mounting of the lighting enclosure 10 between ceiling joists spaced at 16.0 inch centers, as illustrated in FIG. 6, while the lengthwise dimension of the second and fourth side walls 24 and 28 is selected to facilitate mounting of the lighting enclosure 10 between ceiling joists spaced at 12.0 inch centers, as illustrated in FIG. 5.

Figure 3:
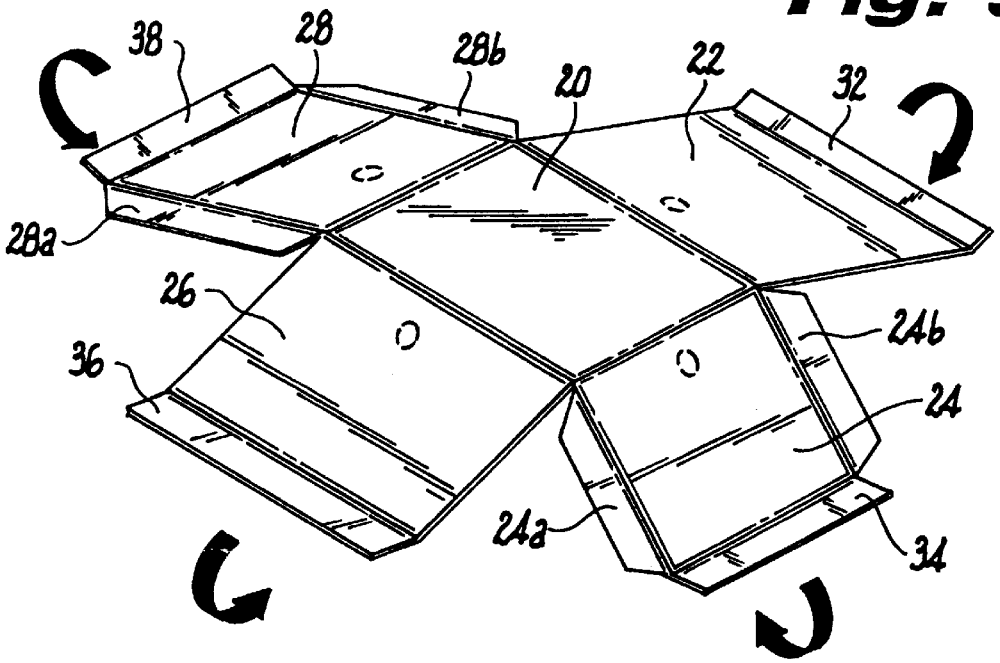
FIG. 3 illustrates the manner in which the stamped sheet metal blank illustrated in FIG. 2 is folded to form the enclosure of FIG. 1.

The second and fourth side walls 24 and 28 are each provided with opposed lateral tabs 24*a* and 24*b*, and 28*a* and 28*b*, respectively. These lateral tabs are configured for attachment to the first and third side walls 22 and 26 to facilitate construction of the enclosure 10, as shown for example in FIG. 3. Those skilled in the art will readily appreciate that the lateral tabs could alternatively be provided on the first and third side walls 24 and 28. The tabs are preferably secured to the first and third side walls of the enclosure by spot welding or a similar metal joining technique well known in the art. Other methods of joining the side walls are also envisioned, such as, for example, welding or securement with fasteners and brackets.

Mounting flanges are defined on each of the four side walls of enclosure 10 and include flanges 32, 34, 36 and 38 which depend outwardly from the bottom edges of the first through fourth side walls 22, 24, 26, and 28, respectively. The first through fourth side walls of lighting enclosure 10 are each provided with an aperture for accommodating electrical wires of a recessed lighting fixture enclosed thereby. These include apertures 42, 44, 46 and 48 which are preferably stamped through the side walls, but which in the alternative, may be provided as perforated knock-outs, a concept that is common in the construction industry.

As best seen in FIG. 1, the interior surfaces of lighting enclosure 10 are provided with a layer or covering material, designated generally by reference numeral 50, which is intended to prevent the propagation of fire. The material 50 is selected from a group of fire resistant materials including cementitious and intumescent materials, or other tested and approved materials. Cementitious fire proofing materials are inorganic materials that are supplied as a powder which is mixed with water and sprayed on surfaces, such as the interior of enclosure 10, in a thickness and density required to achieve fire resistant ratings in accordance with known building codes. Typically, the hourly fire rating for such materials will vary from one to four hours depending upon the applied thickness or number material layers. In a preferred embodiment of the subject invention, such a material is applied with a thickness of about 0.0625 inches to about 1.50 inches so as to provide a firestop system in conformance with the requirements of the U.B.C. A suitable cementitious fire proofing material is marketed under the tradename PYROLITE 15/RETRO-LITE 15 which manufactured and sold by Carboline Fireproofing Products Division, of St. Louis, Mo.

Intumescent fireproofing materials form a passive fire protection which remains inactive until subjected levels of heat upon which time the material expands. Thin film intumescent coatings having a thickness of about 0.0125 inches which may be brushed, rolled or sprayed on steel surfaces are marketed under the tradename CAFCO coating and are available from Isolatek International of Stanhope, N.J. Intumescent composite sheeting materials are also available from 3M Corporation of St. Paul, Minn. These sheets may be cut to desired dimensions and provided with blank openings or penetrations to conform to the geometry of lighting enclosure 10.

In accordance with a preferred embodiment of the subject invention, the fire resistant material is applied to the interior wall surfaces of lighting enclosure 10 during fabrication, i.e., prior to installation between two spaced apart ceiling joists. However, it is envisioned and within the scope of the subject invention that the fire resistant material may be applied to the interior wall surfaces of the lighting enclosure after it has been installed between two spaced apart ceiling joists. It is also envisioned that fire resistant coating materials may be applied to the exterior walls surfaces of lighting enclosure 10, as shown for example in FIGS. 5 and 6.

Figure 4:
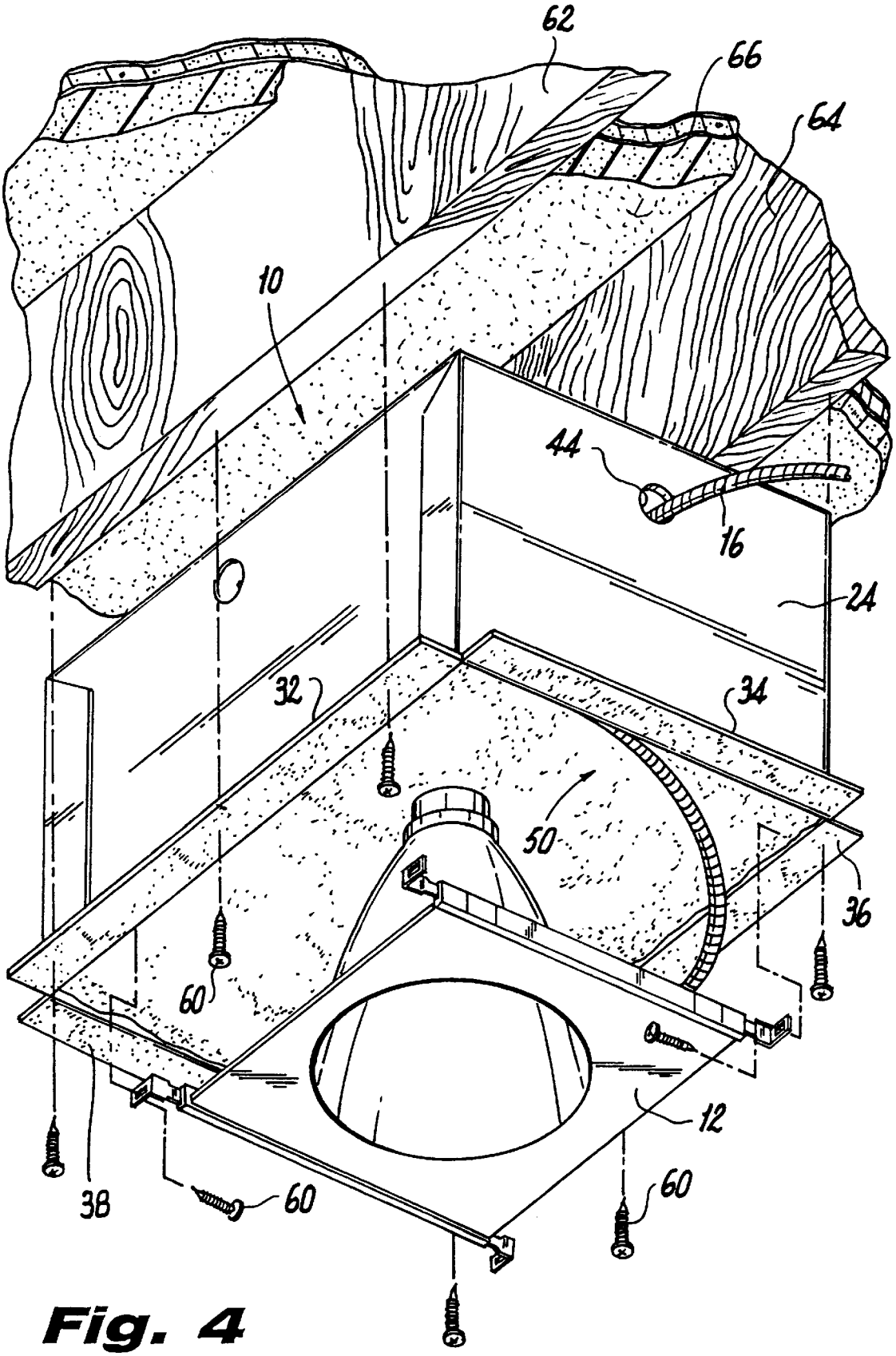
FIG. 4. is a perspective view of a lighting enclosure constructed in accordance with a preferred embodiment of the subject invention as oriented during installation between two adjacent ceiling joists.

Referring now to FIG. 4, to install the fire rated lighting enclosure 10 of the subject invention in a first orientation between two ceiling joists spaced at 12.0 inch centers, mounting flanges 32 and 36 are employed. Conventional screw-type fasteners 60 are utilized to secure the mounting flanges to the lower chords of two spaced apart ceiling joists 62 and 64. Those skilled in the art will readily appreciate that alternative types of fasteners may be employed to secure the mounting flanges to the ceiling joists.

Once the lighting enclosure 10 is properly installed between the two spaced apart joists, a recessed lighting fixture 20 is emplaced therein and secured in a conventional manner utilizing threaded fasteners or the like. Thereafter, a selected one of the apertures formed in the walls of the enclosure is knocked-out to accommodate the electrical wiring 16 associated with lighting fixture 12. A suitable fire-proofing material, such as an intumescent or cementitious material, can then be applied in the area of the wire penetrated aperture to seal the interior of the enclosure, and thereby isolate the lighting fixture 12 from the insulating material 66 disposed between joists 62 and 64.

Thereafter, as illustrated in FIG. 5, a piece of sheet rock 66 is attached to joists 62 and 64 in a conventional manner to define the ceiling of the building construction and a penetration 68 for the recessed lighting fixture mounted thereabove. As illustrated in FIG. 6, when lighting enclosure 10 is installed between two ceiling joists 72 and 74 spaced at 16.0 inch centers, it is disposed in a second orientation in which the opposed mounting flanges 34 and 38 are employed to secure the enclosure to the lower chords of two spaced apart ceiling joists.

Although the subject invention has been described with respect to a preferred embodiment, it is apparent that modifications and changes can be made thereto without departing from the spirit and scope of the invention as defined by the appended claims. In particular, although the subject invention has been described in conjunction with recessed lighting fixtures, those skilled in the art will readily appreciate that the subject invention is suitable for use in conjunction with other recessed fixtures, such as, for example, recessed loudspeakers.

What is claimed is:

1. A method of installing recessed fixtures in a ceiling comprising the steps of:

a) forming a metal housing having a top wall and a plurality of sidewalls configured to enclose a recessed fixture, said top and plurality of sidewalls have exterior and interior wall surfaces;

b) coating the interior wall surfaces of said top wall and plurality of side walls of said metal housing with a fire resistant material selected from a group consisting of cementitious and intumescent coating materials;

c) providing a ceiling penetration to accommodate said recessed fixture;

d) mounting said metal housing between spaced apart building joists adjacent said ceiling penetration, said step of coating the interior wall surfaces of said housing preceding said step of mounting said metal housing between spaced apart building joists, such that said housing defines a firestop system prior to installation, and once installed, limits the spread of fire, flame or hot gasses through said ceiling penetration; and e) emplacing a recessed fixture within said metal housing.

2. A method of installing a recessed fixture according to claim 1, further comprising the step of passing electrical wires through an aperture formed in at least one side wall of said housing.

3. A method of installing a recessed fixture according to claim 2, further comprising the step of sealing said aperture subsequent to said step of passing electrical wires therethrough.

4. A method of installing a recessed fixture according to claim 1, wherein the step of mounting said housing between spaced apart building joists comprises positioning said housing between joists spaced at 12.0 inch centers.

5. A method of installing a recessed fixture according to claim 1, wherein the step of mounting said housing between spaced apart building joists comprises positioning said housing between ioists spaced at 16.0 inch centers.

6. A method of installing a recessed fixture according to claim 1, further comprising the step of coating the exterior wall surfaces of said top wall and plurality of side walls of said metal housing with a fire resistant material selected from a group consisting of cementitious and intumescent coating materials.

7. A method of installing a recessed fixture according to claim 6, wherein said step of coating the exterior wall surfaces of said top wall and plurality of side walls of said metal housing precedes said step of mounting said housing between spaced apart building joists.

8. A method of installing a recessed fixture according to claim 6, wherein said step of coating the exterior wall surfaces of said top wall and plurality of side walls of said metal housing follows said step of mounting said housing between spaced apart building joists.

* * * * *